US005611441A

United States Patent [19]

Bartko

[11] Patent Number: 5,611,441

[45] Date of Patent: Mar. 18, 1997

[54] DEVICE FOR HOUSING THROW PILLOWS DURING WASHING

[76] Inventor: Kimberly A. Bartko, 1245 Five Pines Rd., North Huntington, Pa. 15642

[21] Appl. No.: 292,279

[22] Filed: Aug. 18, 1994

[51] Int. Cl.[6] ..... A47F 5/14

[52] U.S. Cl. ..... 211/181; 211/13; 220/485

[58] Field of Search ..... 211/181, 14, 13; 248/175, 302, 500, 505, 510; 220/485, 486, 489

[56] References Cited

U.S. PATENT DOCUMENTS

| | | | |
|---|---|---|---|
| D. 378,669 | 5/1985 | Walpin . | |
| 548,614 | 10/1895 | Lassen | 220/489 X |
| 1,904,969 | 4/1933 | Cavano et al. | 211/181 X |
| 2,367,448 | 1/1945 | Thiele | 220/485 X |
| 2,575,149 | 11/1951 | Watson | 220/485 X |
| 3,355,027 | 11/1967 | Gibbons | 211/14 X |
| 3,372,636 | 3/1968 | Marasco | 220/485 X |
| 3,533,589 | 10/1970 | Schellmann | 248/500 |
| 3,949,913 | 4/1976 | Smith et al. . | |
| 3,990,616 | 11/1976 | Thompson . | |
| 5,148,954 | 9/1992 | Myers . | |
| 5,172,837 | 12/1992 | Finney, Jr. et al. . | |
| 5,205,208 | 4/1993 | Gongwer | 211/181 X |
| 5,344,029 | 9/1994 | Oghia et al. | 211/181 X |

*Primary Examiner*—Korie Chan
*Attorney, Agent, or Firm*—Daniel J. Long

[57] ABSTRACT

Disclosed is a device that houses a pillow during washing in a washing machine or dish washer. The device includes a lower generally concave housing member having front and rear ends. An upper generally concave housing member having front and rear ends and is superimposed over the lower housing member such that the front end of the upper housing member engages the front end of the lower housing member. The rear end of the upper housing member engages the rear end of the lower housing member such that a pillow housing space is formed between the upper housing member and lower housing member. Projections from the upper and lower housing members extend into this pillow housing space to firmly retain the pillow during washing.

15 Claims, 7 Drawing Sheets

DEVICE FOR HOUSING THROW PILLOWS DURING WASHING

BACKGROUND OF THE INVENTION

1. Field of the Invention

The present invention relates to devices for use in the fluid treatment of textile goods and more particularly to devices for cleaning pillows.

2. Brief Description of the Prior Art

Various methods are conventionally used to clean pillows, including throw pillows. Such cleaning often presents a particular problem in that cleaning may tend to deform the shape of the pillow. A number of manufacturers recommend that throw pillows be cleaned by professional dry cleaners or that the pillows be carefully washed by hand. In other cases throw pillows are machine washed on a delicate cycle, but that procedure may eventually cause pillows to loose their intended shapes.

It is, therefore, the object of the present invention to provide a means for washing pillows in home washing machines and dish washers which will effectively clean the pillows while allowing their intended shapes to be maintained.

SUMMARY OF THE INVENTION

The device of the present invention is a housing for a pillow, and in particular a throw pillow, during washing in a washing machine or dish washer. The device includes a lower generally concave housing member having front and rear ends. An upper generally concave housing member having front and rear ends and is superimposed over the lower housing member such that the front end of said upper housing member engages the front end of said lower housing member. The rear end of the upper housing member engages the rear end of the lower housing member such that a pillow housing space is formed between the upper housing member and lower housing member. There is also a means for disengaging the front end of the upper housing member from the front end of the lower housing member so as to allow access to the interior pillow housing space. A central pillow retaining means extending into the interior pillow housing space. Preferably the rear end of the upper housing member and the rear end of the lower housing member are pivotally attached to one another to allow the upper housing member to pivot in a vertical arc relative to the lower housing member. Preferably the means for disengaging the front end of the upper housing member from the front end of the lower housing member is a clamping means which when disengaged allows the upper housing means to be upwardly pivoted in a vertical arc to allow access to the interior pillow housing space. The central pillow retaining means may be a projection extending downwardly from the upper housing member to firmly hold a pillow retained in the interior pillow retaining space. A projection may also extend upwardly from the lower housing member so that the enclosed pillow is firmly retained between these projections.

BRIEF DESCRIPTION OF THE DRAWINGS

The present invention is further described with reference to the accompanying drawings in which.

DETAILED DESCRIPTION

Figure 2:
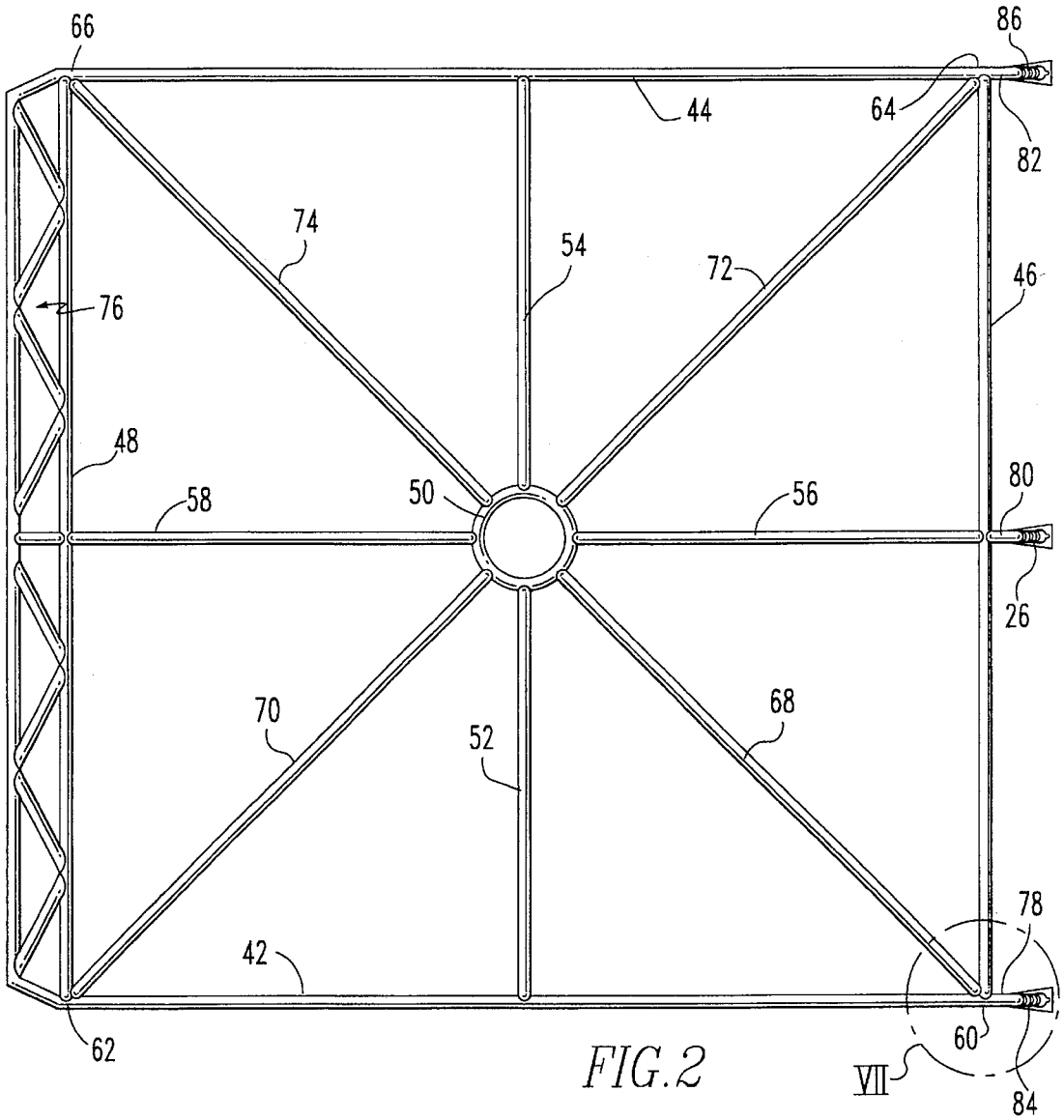
FIG. 2 is plan view of the pillow housing device shown in FIG. 1.
Figure 1:
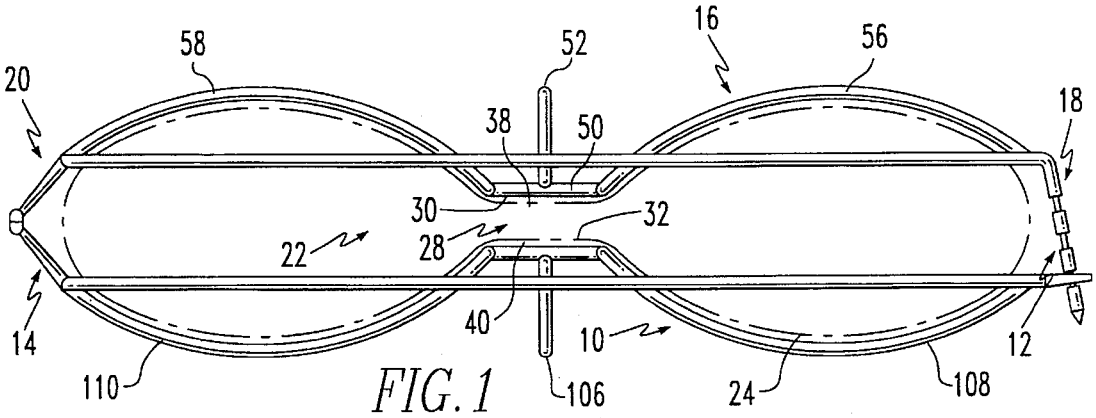
FIG. 1 is a side elevational view of a preferred embodiment of the pillow housing device of the present invention.
Figure 3:
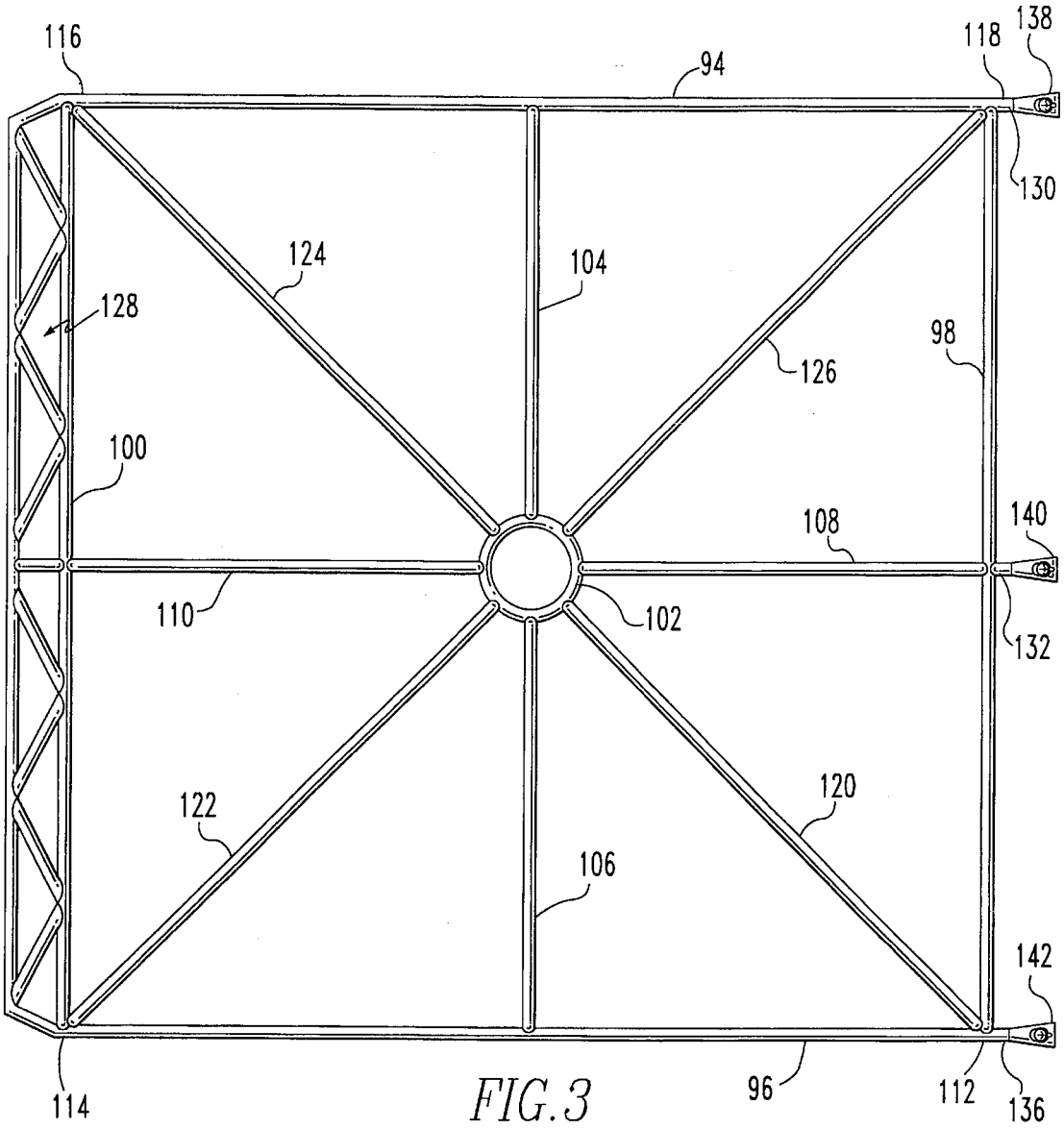
FIG. 3 is a bottom view of the pillow housing device shown in FIG. 1.
Figure 4:
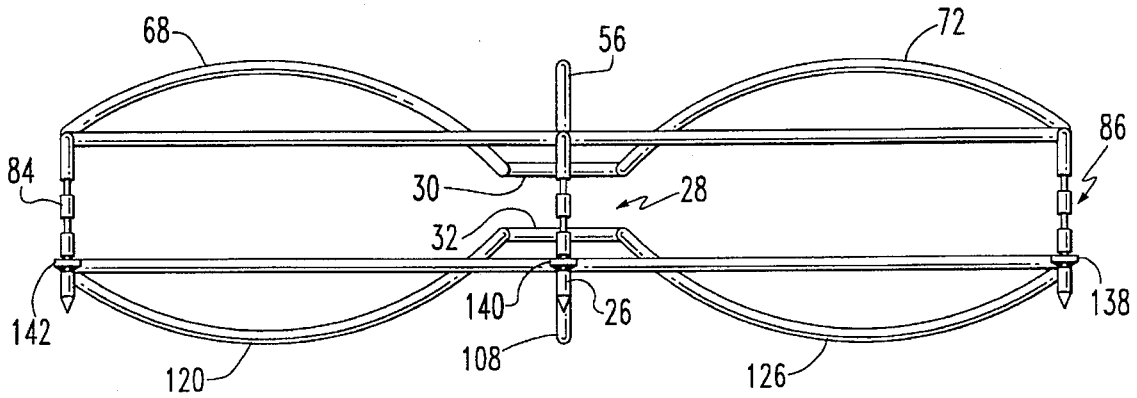
FIG. 4 is a front end view of the pillow housing device shown in FIG. 1.
Figure 5:
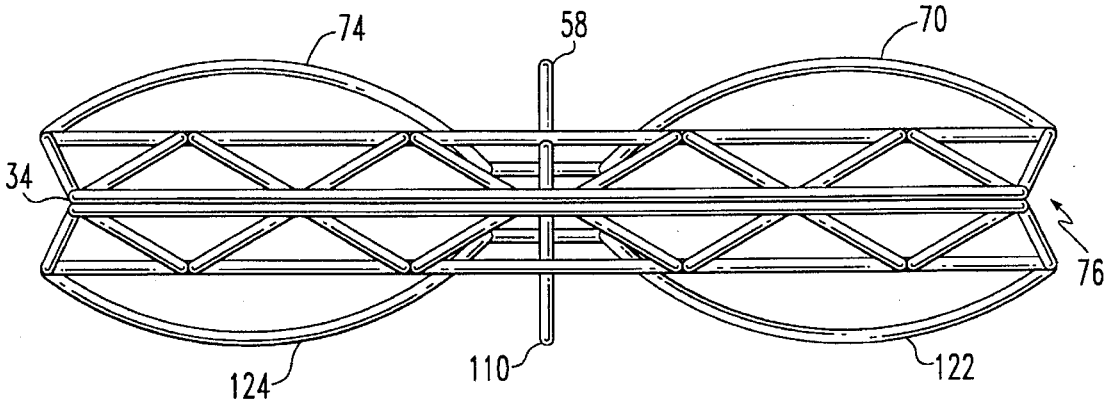
FIG. 5 is a rear end view of the pillow housing device shown in FIG. 1.
Figure 6:
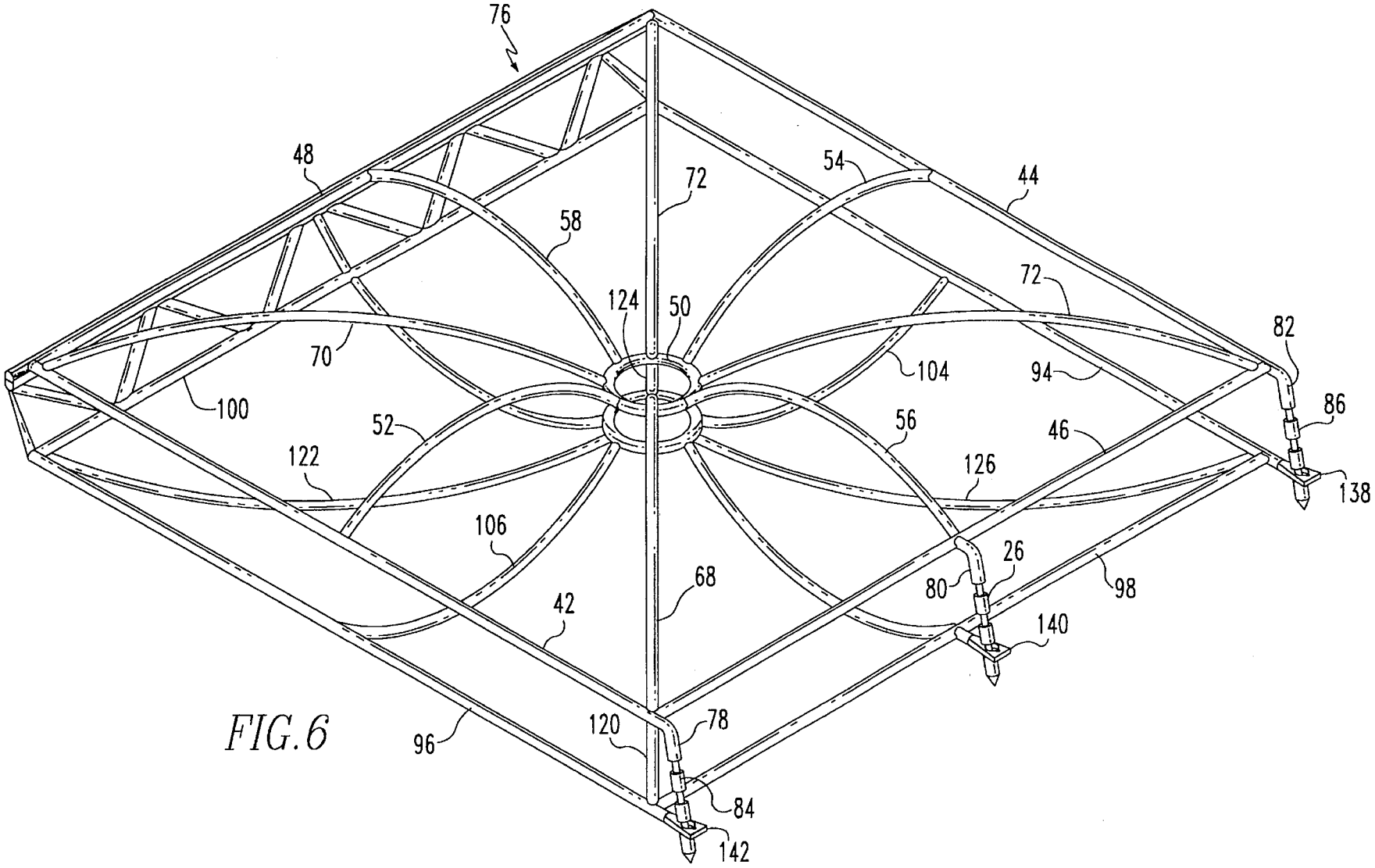
FIG. 6 is a perspective view of the device shown in FIG. 1.
Figure 7:
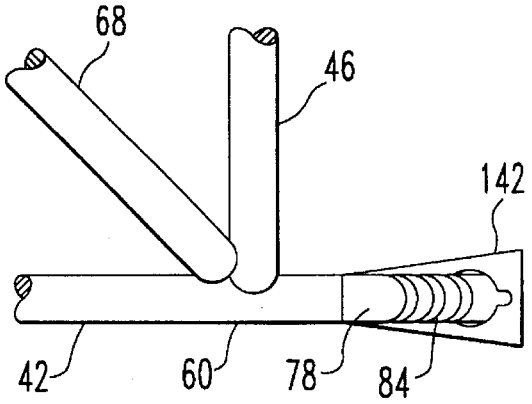
FIG. 7 is a detailed view of the area within circle VII in FIG. 2.
Figure 8:
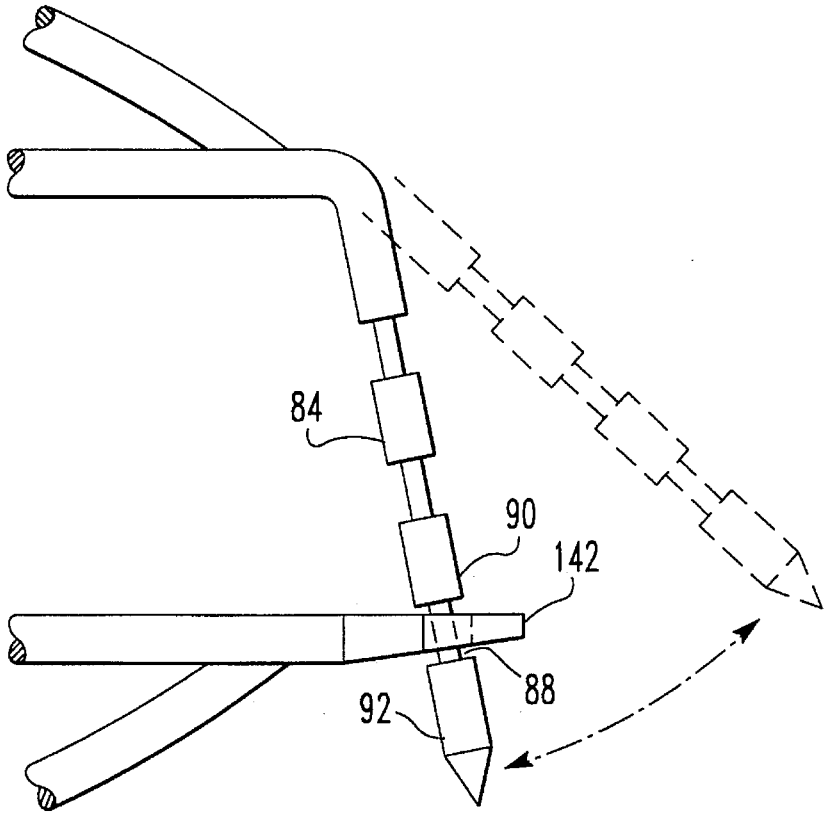
FIG. 8 is a detailed side view in fragment of a engaged clamping device used in the pillow housing device shown in FIG. 1.
Figure 10:
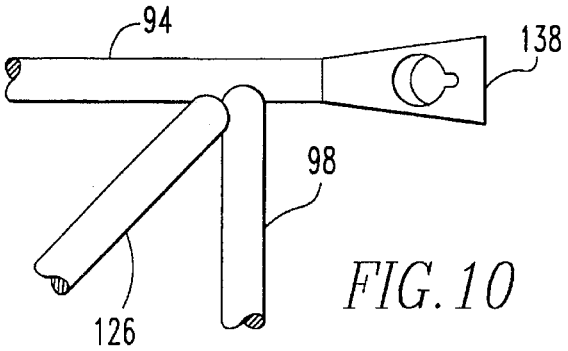
FIG. 10 is a detailed front view in fragment of the lower section of the clamping device shown in FIG. 8.
Figure 11:
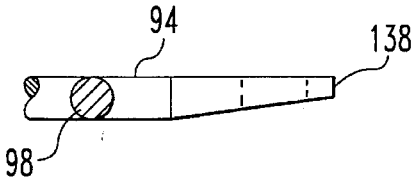
FIG. 11 is a detailed side view in fragment of the lower section of the clamping device shown in FIG. 10.
Figure 9:
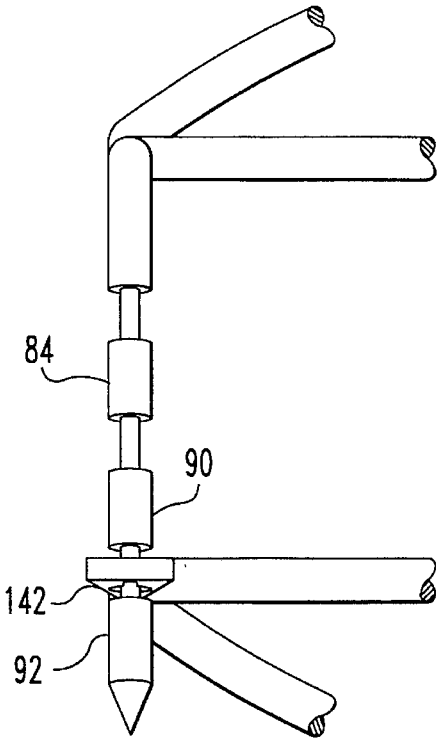
FIG. 9 is a detailed front view of the engaged clamping device shown in FIG. 8.
Figure 12:
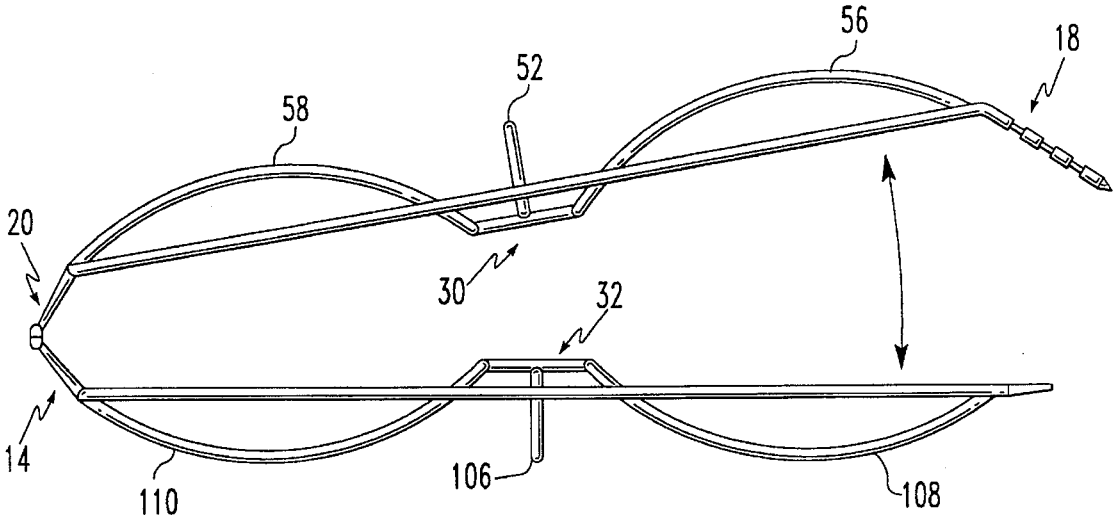
FIG. 12 is a side view similar to FIG. 1 in which the device is in its open position.

Referring to the drawings, the device for housing a pillow comprises a lower generally concave housing member shown generally at numeral 10 and having a front end 12 and a rear end 14. Superimposed over said lower housing member is an upper concave housing member shown generally at numeral 16. It will be seen that the front end 18 of the upper housing member engages the front end of said lower housing member and the rear end 20 of the upper housing member engages the rear end of the lower housing member and such that a pillow housing space 22 is formed between the upper housing member and lower housing member to hold a pillow shown in phantom lines at 24. Means such as clamp 26 for disengaging the front end of the upper housing member from the front end of the lower housing member so as to allow access to the interior pillow housing space are also provided. A central pillow retaining means shown generally at numeral 28 which may be a combination of a downwardly extending projection 30 and an upwardly extending projection 32 extends into the interior pillow housing space. The rear end of the upper housing member and the rear end of the lower housing member are pivotally attached to one another at pivoting point 34 to allow the upper housing member to pivot in a vertical arc relative to the lower housing member. The projections comprising the central pillow retaining means firmly hold the pillow retained in the interior pillow retaining space. That is the projection extending downwardly from the upper housing member bears against the central section of the pillow on its upper side 38 and the projection extending upwardly from the lower housing member bears against the central section of the pillow on its lower side 40.

It will be seen that the upper housing member is a frame comprising a parallel transversely spaced first longitudinal bar 42 and second longitudinal bar 44, a parallel longitudinally spaced first transverse bar 46 and second transverse bar 48, a central support member 50, a pair of transverse upwardly extending arc members 52 and 54 in which the first of said pair of arc members connects the first longitudinal bar with the central support and the other of said pair of arc members connects the central support member to the second longitudinal bar. There are also a pair of longitudinal upwardly extending arc members 56 and 58 wherein the first of said pair of arc members connects the first transverse bar with the central support and the other of said pair of arc members connecting the central support member to the second transverse bar. The frame also includes four frame corners 60, 62, 64 and 66 which are formed by intersections of the first and second longitudinal bars with the first and second transverse bars and each of said corners are connected to the central support member by an upwardly extending diagonal arc member 68, 70, 72 and 74. It will also be seen that the first and second longitudinal bars and the first and second transverse bars are in a common horizontal plane and the central support means is vertically displaced below said horizontal plane to form the projection downwardly extending from the upper housing member. At the rear end of the upper housing member is a rear frame assembly shown generally at numeral 76 which extends rearwardly from the second transverse bar. The front end of the upper concave housing member frame comprises a plurality of transversely spaced longitudinal extension bars 78, 80 and 82 each of said bars having a terminal clamp respectively at 26, 84 and 86. Each of these terminal clamps comprises at least one narrow cylindrical section 88 longitudinally interposed between two thicker cylindrical sections 90 and 92 so as to be engageable at said narrow section with a connecting perforated member.

It will also be seen that the lower housing member is a frame comprising a parallel transversely spaced first longitudinal bar 94 and second longitudinal bar 96, a parallel longitudinally spaced first transverse bar 98 and second transverse bar 100, a central support member 102, a pair of transverse downwardly extending arc members 104 and 106 in which the first of said pair of arc members connects the first longitudinal bar with the central support and the other of said pair of arc members connects the central support member to the second longitudinal bar. There are also a pair of longitudinal downwardly extending arc members 108 and 110 wherein the first of said pair of arc members connects the first transverse bar with the central support and the other of said pair of arc members connecting the central support member to the second transverse bar. The frame also includes four frame corners 112, 114, 116 and 118 which are formed by intersections of the first and second longitudinal bars with the first and second transverse bars and each of said corners are connected to the central support member by an downwardly extending diagonal arc member 120, 122, 124 and 124. It will also be seen that the first and second longitudinal bars and the first and second transverse bars are in a common horizontal plane and the central support means is vertically displaced below said horizontal plane to form the projection upwardly extending from the lower housing member. At the rear end of the lower housing member is a rear frame assembly shown generally at numeral 128 which extends rearwardly from the second transverse bar. The front end of the lower concave housing member frame comprises a plurality of transversely spaced longitudinal extension bars 130, 132 and 136 each of said bars has a terminal perforated member respectively at 138, 140 and 142. Each of these perforated members engages a narrow cylindrical section as at 88 longitudinally interposed between two thicker cylindrical sections as at 90 and 92 so as to be engageable at said narrow section respectively on clamp members 26, 84 and 86.

The material from which the above described frames will preferably be a suitable polystyrene or polyvinyl which is in the form of a roll which about ¼ inch in diameter and cross sectionally round or oval shaped rods.

Although the invention has been described in detail, it will be understood that the disclosure has been made only as an example and that the scope of the invention is defined by the following claims.

What is claimed is:

1. A device for housing a pillow during washing in a washing machine or dish washer comprising:

(a) a lower generally concave housing member having front and rear ends;

(b) an upper generally concave housing member having front and rear ends and being superimposed over said lower housing member such that the front end of said upper housing member engages the front end of said lower housing member and the rear end of said upper housing member engages the rear end of the lower housing member and such that a pillow housing space is formed between said upper housing member and lower housing member and the rear end of the upper housing member and the rear end of the lower housing member are pivotally attached to one another to allow the upper housing member to pivot in a vertical arc relative to the lower housing member;

(c) means for disengaging the front end of the upper housing member from the front end of the lower housing member so as to allow access to the interior pillow housing space and the means for disengaging the front end of the upper housing member from the front end of the lower housing member is a clamping means which when disengaged allows the upper housing means to be upwardly pivoted in said vertical arc to allow access to the interior pillow housing space; and (d) central pillow retaining means extending into the interior pillow housing space, said pillow retaining means comprising a projection extending downwardly into the interior pillow housing space from the upper housing member and a central support member extending upwardly into the interior pillow housing space from the lower housing member toward the central support member of the upper housing member and said projections cooperate to define means for gripping the pillow retained in the interior pillow retaining space.

2. The device of claim 1 in combination with the pillow wherein the pillow has a central section and an upper side and a lower side and the central support member extending downwardly from the upper housing member bears against the central section of the pillow on the upper side and the central support member extending upwardly from the lower housing member bears against the central section of the pillow on the lower side.

3. The device of claim 1 wherein the upper housing member is a frame comprising a parallel transversely spaced first longitudinal bar and second longitudinal bar, a parallel longitudinally spaced first transverse bar and second transverse bar, the central support member, a first and a second transverse upwardly extending arc member, said first transverse arc member connecting the first longitudinal bar with the central support and said second transverse arc member connecting the central support member to the second longitudinal bar and a first and a second longitudinal upwardly extending arc member, the first longitudinal arc member connecting the first transverse bar with the central support and the second longitudinal arc member connecting the central support member to the second transverse bar.

4. The device of claim 3 wherein four frame corners are formed by intersections of the first and second longitudinal bars with the first and second transverse bars and each of said corners are connected to the central support member by diagonal upwardly extending arc members.

5. The device of claim 4 wherein the first and second longitudinal bars and the first and second transverse bars are in a common horizontal plane and a central support member is vertically displaced below said horizontal plane to form a projection downwardly extending from the upper housing member.

6. The device of claim 5 wherein the rear end of the upper housing member is a rear frame assembly extending rearwardly from the first transverse bar and the rear end of the housing member also include a rear frame assembly.

7. The device of claim 6 wherein the front end of the upper housing means comprises a plurality of transversely spaced longitudinal extension bars each of said bars having a terminal clamping means.

8. The device of claim 7 wherein said clamping means comprises perforated members extending longitudinally from the lower housing member, and each of said terminal clamping means of said housing member comprises at least one narrow cylindrical section longitudinally interposed between two thicker cylindrical sections so as to be engageable at said narrow section with one of the respective perforated members.

9. The device of claim 6 wherein the rear frame assembly of the upper housing member is pivotally connected to the rear frame member of the lower housing member to allow the upper frame member to pivot in said vertical arc above the lower housing member.

10. The device of claim 1 wherein the lower housing member is a frame comprising a parallel transversely spaced first longitudinal bar and second longitudinal bar, a parallel longitudinally spaced first transverse bar and second transverse bar, the central support member, a first and a second transverse downwardly extending arc member, said first transverse arc member connecting the first longitudinal bar with the central support and said second transverse arc member connecting the central support member to the second longitudinal bar and a first and a second longitudinal upwardly extending arc member, said first longitudinal arc member connecting the first transverse bar with the central support and said second longitudinal arc member connecting the central support member to the second transverse bar.

11. The device of claim 10 wherein four frame corners are formed by intersections of the first and second longitudinal bars with the first and second transverse bars and each of said corners are connected to the central support member by downwardly extending diagonal arc members.

12. The device of claim 11 wherein the first and second longitudinal bars and the first and second transverse bars are in a common horizontal plane and the central support member is vertically displaced above said horizontal plane to form a projection upwardly extending from the lower housing member.

13. The device of claim 12 wherein the rear end of the lower housing member is a rear frame assembly extending rearwardly from the first transverse bar.

14. The device of claim 13 wherein the front end of the upper housing means comprises a plurality of transversely spaced longitudinal extension bars each of said bars having a terminal clamping means.

15. The device of claim 14 wherein each of said terminal clamping means comprises a narrow cylindrical section longitudinally interposed between two thicker cylindrical sections.

* * * * *